US012203255B2

(12) United States Patent
Samuels

(10) Patent No.: US 12,203,255 B2
(45) Date of Patent: Jan. 21, 2025

(54) BLOCKAGE CLEARING DEVICE

(71) Applicant: PLUNGE KING LLC, Reseda, CA (US)

(72) Inventor: Bruce Samuels, Reseda, CA (US)

(73) Assignee: PLUNGE KING LLC, Reseda, CA (US)

( * ) Notice: Subject to any disclaimer, the term of this patent is extended or adjusted under 35 U.S.C. 154(b) by 27 days.

(21) Appl. No.: 17/869,048

(22) Filed: Jul. 20, 2022

(65) Prior Publication Data

US 2024/0026670 A1 Jan. 25, 2024

(51) Int. Cl.
*E03C 1/308* (2006.01)

(52) U.S. Cl.
CPC ..... *E03C 1/308* (2013.01)

(58) Field of Classification Search
CPC ..... E03C 1/308
See application file for complete search history.

(56) References Cited

U.S. PATENT DOCUMENTS

| | | | | |
|---|---|---|---|---|
| 5,522,094 | A * | 6/1996 | Balazs | E03C 1/308 4/255.02 |
| 9,328,492 | B2 * | 5/2016 | Cohen | E03C 1/308 |
| 2010/0058519 | A1 * | 3/2010 | Davenport | E03C 1/308 4/255.04 |
| 2019/0003168 | A1 * | 1/2019 | Hennessy | E03C 1/308 |
| 2022/0170250 | A1 * | 6/2022 | Wu | E03C 1/308 |

* cited by examiner

*Primary Examiner* — Christine J Skubinna
(74) *Attorney, Agent, or Firm* — CP LAW GROUP PC; Cy Bates

(57) ABSTRACT

A blockage clearing device is disclosing having a reservoir tube with a hollow interior configured to hold an amount of fluid. A piston plunger is disposed within the hollow interior of the reservoir tube and an injector nozzle is coupled to an end of the reservoir tube, the injector nozzle having an injector opening configured to receive and release fluid. A gasket seal surrounds the injector nozzle wherein the injector opening is accessible from an exterior of the gasket seal. The gasket seal is configured to fit between a siphon waste and siphon jet of a toilet wherein the siphon waste is sealed from the siphon jet.

18 Claims, 10 Drawing Sheets

BLOCKAGE CLEARING DEVICE

BACKGROUND

Field of the Invention

This invention relates to a plumbing apparatus; more particularly, a blockage clearing device having advantages over a conventional plunger.

Description of the Related Art

Conventional plungers and known variations are commonly used to clear a blockage in a toilet. The conventional plungers generally comprise a rubber cup which is placed at a lower toilet aperture to provide both suction and pressure to a waste siphon. During such agitation, fecal contaminated fluid can travel back through the toilet's siphon jet and into the toilet bowl. This can create foul odors and spillage. Additionally, because the siphon jet is not sealed from the siphon waste, conventional plungers are limited to how much pressure and suction can be applied. Other toilet blockage removal devices that use an external water source (such as hose or faucet) are known, however water can travel back through the siphon jet and into the toilet bowl, thereby overflowing the toilet. Conventional plungers and other blockage removal devices can clear minor blockages but have difficulty clearing tougher ones.

There is a need for an improved blockage clearing device which can solve the above deficiencies.

SUMMARY

The disclosure concerns blockage clearing device. The blockage clearing device comprises a reservoir tube with a hollow interior configured to hold an amount of fluid. A piston plunger is disposed within the hollow interior of the reservoir tube. An injector nozzle is coupled to an end of the reservoir tube, the injector nozzle having an injector opening configured to receive and release fluid. A gasket seal surrounds the injector nozzle wherein the injector opening is accessible from an exterior of the gasket seal.

BRIEF DESCRIPTION OF THE DRAWINGS

Other features, combinations, and embodiments will be appreciated by one having the ordinary level of skill in the art of blockage clearing devices and accessories upon a thorough review of the following details and descriptions, particularly when reviewed in conjunction with the drawings, wherein.

DETAILED DESCRIPTION

Figure 1:
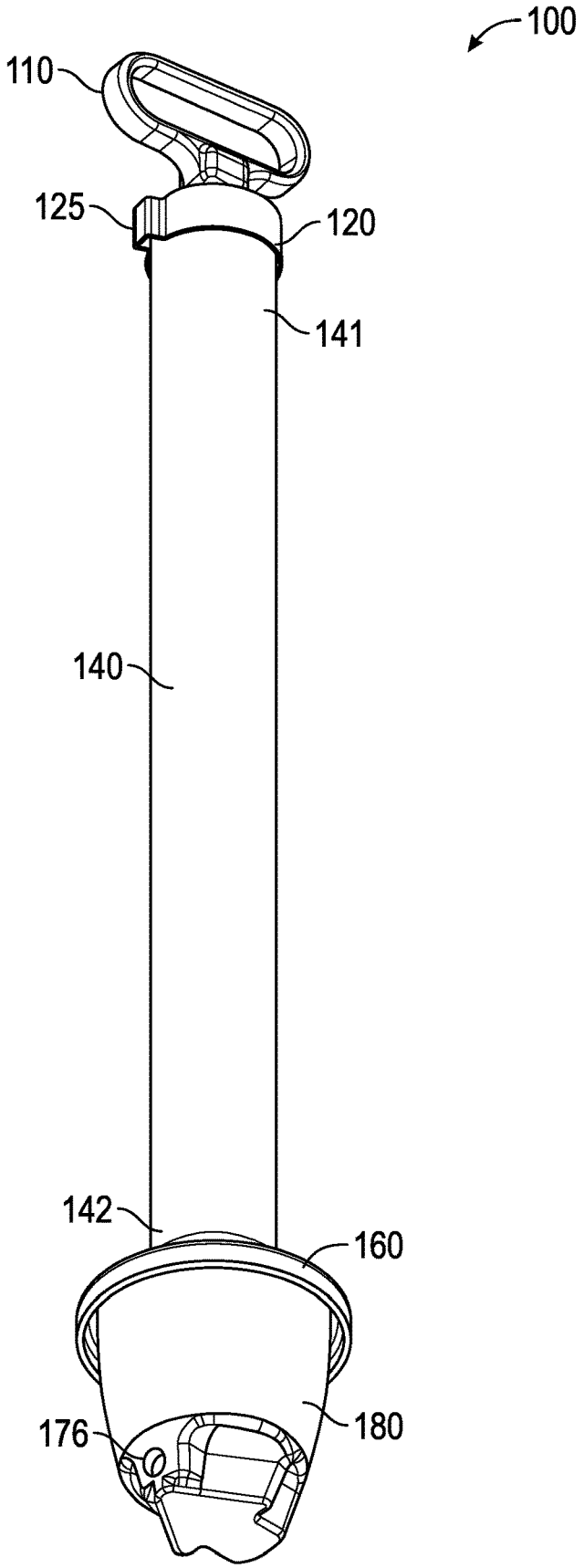
FIG. 1 shows a perspective view of a blockage clearing device in accordance with a first illustrated embodiment.

For purposes of explanation and not limitation, details and descriptions of certain preferred embodiments are hereinafter provided such that one having ordinary skill in the art may be enabled to make and use the invention. These details and descriptions are representative only of certain preferred embodiments, however, a myriad of other embodiments which will not be expressly described will be readily understood by one having skill in the art upon a thorough review of the instant disclosure. Accordingly, any reviewer of the instant disclosure should interpret the scope of the invention only by the claims, as such scope is not intended to be limited by the embodiments described and illustrated herein.

For purposes herein, the term "siphon junction" means a space in the toilet below the lower bowl aperture and between the siphon jet and siphon waste. Fluid from the siphon jet travels through the siphon junction before entering the siphon waste.

Unless explicitly defined herein, terms are to be construed in accordance with the plain and ordinary meaning as would be appreciated by one having skill in the art.

General Description of Embodiments

In one embodiment, a blockage clearing device is disclosed. The blockage clearing device comprises a reservoir tube having a tube proximal end and a tube distal end opposite the tube proximal end, and a hollow interior extending from the tube proximal end to the tube distal end, a reservoir cap having a cap bottom side coupled to the tube proximal end, the reservoir cap further comprising a plunger aperture extending through the reservoir cap, a piston plunger having a piston proximal end and a piston distal end opposite the piston proximal end, the piston proximal end extending through the reservoir cap, wherein the piston plunger further extends within the hollow interior of the reservoir tube, a piston plunger seal coupled to the piston plunger at the piston distal end, the piston plunger seal comprising a piston seal periphery configured to abut an inner wall of the reservoir tube, a reservoir coupling coupled to the reservoir tube at the tube distal end, the reservoir coupling comprising an anti-drip seal, an injector nozzle coupled to the reservoir coupling, the injector nozzle having a top side a bottom side, and an outer side surface extending from the top side to the bottom side, the injector nozzle further comprising an injector opening configured to receive and release a fluid, and a gasket seal coupled to and surrounding the injector nozzle, wherein the injector opening is accessible from an exterior of the gasket seal.

In some embodiments, the gasket seal may further comprise a top portion and a bottom portion opposite the top portion, wherein the top portion is coupled to the reservoir coupling and the bottom portion comprises a gasket direction indicator aligned with the injector opening.

In some embodiments, the gasket seal may further comprise a top portion and a bottom portion opposite the top portion, the top portion being larger than the bottom portion wherein the gasket seal is characterized as having a conical shape.

In some embodiments, the gasket seal may further comprise a gasket width and a gasket depth configured to fit within a siphon junction of a toilet.

In some embodiments, the gasket seal may further comprise a resiliently deformable gasket material configured to seal a waste siphon from a siphon jet.

In some embodiments, the injector nozzle may further comprise one or more flanges disposed on the outer side surface of the injector nozzle. The one or more flanges may comprise flange apertures extending through the one or more flanges. In some embodiments, at least one of the one or more flanges is coupled to the outer side surface of the injector nozzle and further coupled to an opening channel.

In some embodiments, the injector opening may extend outwardly from the outer side surface by an opening channel. The opening channel may be disposed at the bottom side of the injector nozzle.

In some embodiments, the injector nozzle may further comprise an upper diameter disposed at the top side, and a lower diameter disposed at the bottom side, wherein the upper diameter is greater than the lower diameter.

In some embodiments, the anti-drip seal may be disposed inside the injector nozzle.

In some embodiments, the anti-drip seal may further comprise a plurality of flaps. The anti-drip seal may further comprise a seal upper surface, a seal bottom surface opposite the seal upper surface, and a center portion, wherein each of the plurality of flaps comprise an upward arch.

In some embodiments, the reservoir cap may comprise a reservoir vent coupled to a cap side surface of the reservoir cap. The reservoir vent may comprise a vent opening disposed at the cap bottom side. In some embodiments, the reservoir vent and the piston plunger comprise a parallel formation.

In some embodiments, the reservoir cap may further comprise a cap direction indicator.

In some embodiments, the blockage clearing device may further comprise a device stand configured to surround the gasket seal.

In another embodiment, a blockage clearing device is disclosed a blockage clearing device is disclosed. The blockage clearing device comprises a reservoir tube having a tube proximal end and a tube distal end opposite the tube proximal end, and a hollow interior extending from the tube proximal end to the tube distal end, a piston plunger having a piston proximal end and a piston distal end opposite the piston proximal end wherein the piston plunger extends within the hollow interior of the reservoir tube, an injector nozzle coupled to the reservoir tube, the injector nozzle having a top side, a bottom side, and an outer side surface extending from the top side to the bottom side, the injector nozzle further comprising an injector opening configured to receive and release a fluid, and a gasket seal coupled to and surrounding the injector nozzle, wherein the injector opening is accessible from an exterior of the gasket seal.

In some embodiments, the blockage clearing device may further comprise a reservoir cap having a cap bottom side coupled to the tube proximal end, the reservoir cap further comprising a plunger aperture extending through the reservoir cap wherein the piston plunger extends through the plunger aperture.

In some embodiments, the blockage clearing device may further comprise a reservoir coupling coupled to the reservoir tube at the tube distal end, the reservoir coupling comprising an anti-drip seal.

In some embodiments, the blockage clearing device may further comprise a piston plunger seal coupled to the piston plunger at the piston distal end, the piston plunger seal comprising a piston seal periphery configured to abut an inner wall of the reservoir tube.

In some embodiments, the gasket seal may further comprise a top portion and a bottom portion opposite the top portion, wherein the top portion is coupled to the reservoir coupling and the bottom portion comprises a gasket direction indicator aligned with the injector opening.

In some embodiments, the gasket seal may further comprise a top portion and a bottom portion opposite the top portion, the top portion being larger than the bottom portion wherein the gasket seal is characterized as having a conical shape.

In some embodiments, the gasket seal may further comprise a gasket width and a gasket depth configured to fit within a siphon junction of a toilet.

In some embodiments, the gasket seal may further comprise a resiliently deformable gasket material configured to seal a waste siphon from a siphon jet.

In some embodiments, the injector nozzle may further comprise one or more flanges disposed on the outer side surface of the injector nozzle. The one or more flanges may comprise flange apertures extending through the one or more flanges. In some embodiments, at least one of the one or more flanges is coupled to the outer side surface of the injector nozzle and further coupled to an opening channel.

In some embodiments, the injector opening may extend outwardly from the outer side surface by an opening channel. The opening channel may be disposed at the bottom side of the injector nozzle.

In some embodiments, the injector nozzle may further comprise an upper diameter disposed at the top side, and a lower diameter disposed at the bottom side, wherein the upper diameter is greater than the lower diameter.

In some embodiments, the anti-drip seal may be disposed inside the injector nozzle.

In some embodiments, the anti-drip seal may further comprise a plurality of flaps. The anti-drip seal may further comprise a seal upper surface, a seal bottom surface opposite the seal upper surface, and a center portion, wherein each of the plurality of flaps comprise an upward arch.

In some embodiments, the reservoir cap may comprise a reservoir vent coupled to a cap side surface of the reservoir cap. The reservoir vent may comprise a vent opening disposed at the cap bottom side. In some embodiments, the reservoir vent and the piston plunger comprise a parallel formation.

In some embodiments, the reservoir cap may further comprise a cap direction indicator.

In some embodiments, the blockage clearing device may further comprise a device stand configured to surround the gasket seal.

Manufacturing

The gasket seal comprises a resiliently deformable gasket material configured to fit within a siphon junction of a toilet while sealing the siphon waste from the toilet bowl and the siphon jet. An example of such a material may comprise a rubber having a shore hardness of 5 to 10 on the A scale. Other materials may also be used.

Generally, many parts of the blockage clearing device is made of thermoplastics including the reservoir tube, piston plunger, piston plunger handle, and injector nozzle. Otherwise, they can be fabricated in accordance with the level and knowledge of one having skill in the art.

Each of the components of the blockage clearing device and related system described herein may be manufactured and/or assembled in accordance with the conventional knowledge and level of a person having skill in the art. Coupling of components described herein can by accomplished by fasteners, adhesives, threaded fitment, friction fitment, or any other means as can be appreciated by one having skill in the art.

While various details, features, combinations are described in the illustrated embodiments, one having skill in the art will appreciate a myriad of possible alternative combinations and arrangements of the features disclosed herein. As such, the descriptions are intended to be enabling only, and non-limiting. Instead, the spirit and scope of the invention is set forth in the appended claims.

First Illustrated Embodiment

FIG. 1 shows a perspective view of a blockage clearing device (100) in accordance with a first illustrated embodiment. The blockage clearing device comprises a reservoir tube (140) having a tube distal end (142) and a tube proximal end (141) opposite the tube distal end. Coupled to the tube distal end is an injector nozzle (not shown), the injector nozzle being entirely encapsulated by a gasket seal (180) with only an injector opening (176) extending through the gasket seal. The coupling of the injector nozzle to the reservoir tube is aided by a reservoir coupling (160). Coupled to the tube proximal end is a reservoir cap (120). Extending through the reservoir tube and reservoir cap is a piston plunger (not shown) which is coupled to a piston plunger handle (110).

Figure 2:
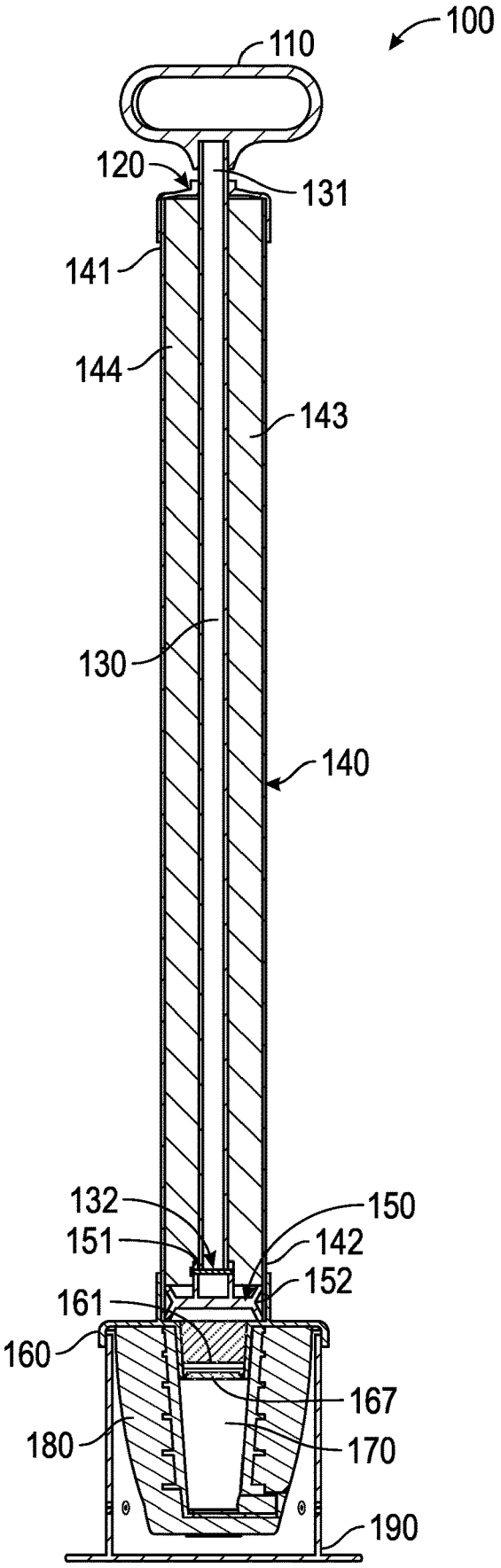
FIG. 2 shows a cross-section view of the blockage clearing device according to the first illustrated embodiment.

FIG. 2 shows a cross-section view of the blockage clearing device (100) according to the first illustrated embodiment. The blockage clearing device comprises a piston plunger handle (110) coupled to a piston plunger (130) at a piston proximal end (131). A piston distal end (132) opposite the piston proximal end is coupled to a piston plunger seal (150). The piston plunger extends through a reservoir tube (140), the reservoir tube comprising a tube proximal end (141), a tube distal end (142) opposite the tube proximal end, and a hollow interior (143) having an inner wall (144). In a preferred embodiment the reservoir tube is cylindrical although other shapes may also be utilized. The tube proximal end is coupled to a reservoir cap (120) wherein the piston plunger extends through the reservoir cap. The piston plunger seal comprises a piston seal aperture (151) configured to couple with the piston distal end. The piston plunger seal further comprises a piston seal periphery (152) configured to abut the inner wall of the hollow interior such that a seal is formed to allow fluid to charge and discharge within the reservoir tube. The seal from the piston plunger seal should be sufficient such that minimal to no fluid passes through the seal and gathers on an upper portion of the piston plunger seal.

The blockage clearing device (100) further comprises an injector nozzle (170) coupled to the tube distal end (142). In some embodiments, a reservoir coupling (160) is used as an intermediate between the injector nozzle and the reservoir tube (140). In other embodiments, the injector nozzle is coupled directly to the reservoir tube. The reservoir coupling comprises an anti-drip seal (161) held by a seal retainer (167), the anti-drip seal being disposed within the injector nozzle. The injector nozzle is encapsulated on by a gasket seal (180). The blockage clearing device is disposed within a device stand (190) where the reservoir coupling rests on a stand top side (193) of the device stand.

Figure 3:
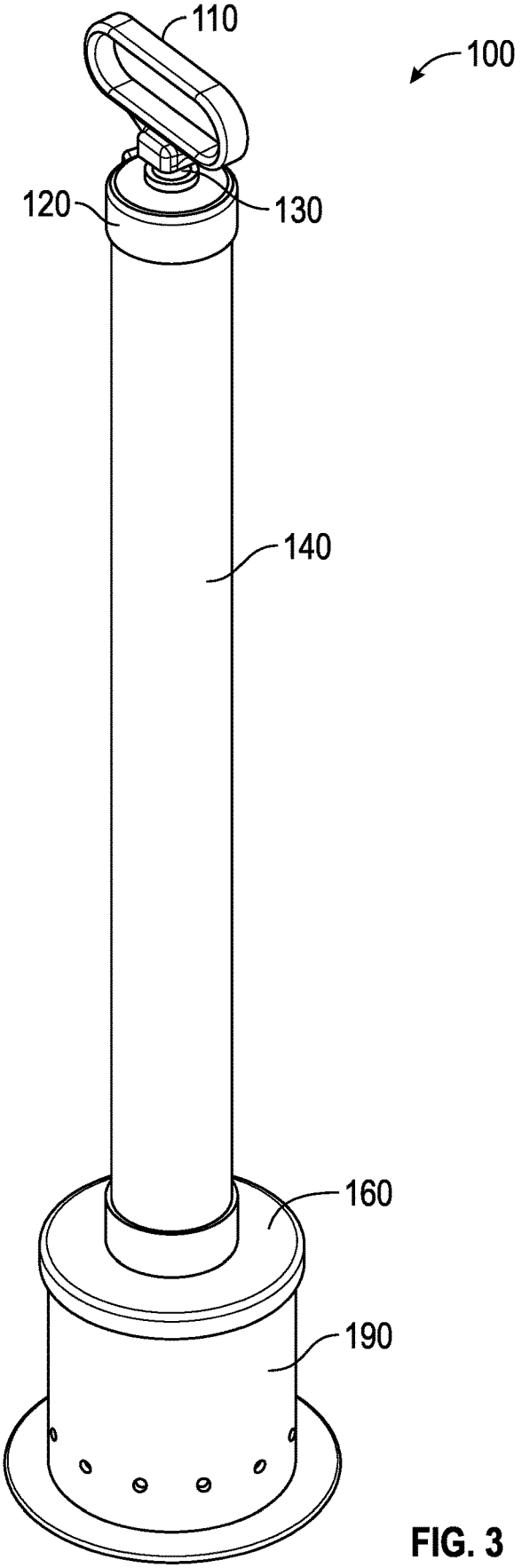
FIG. 3 shows a perspective view of the blockage clearing device with device stand according to the first illustrated embodiment.

FIG. 3 shows a perspective view of the blockage clearing device (100) with device stand (190) according to the first illustrated embodiment. The blockage clearing device includes a piston plunger handle (110) coupled to a piston plunger (130). The piston plunger extends through a reservoir cap (120) and further extends within a reservoir tube (140). A reservoir coupling (160) is coupled to the reservoir tube opposite the reservoir cap. An inject nozzle and gasket seal are disposed within a device stand for storage and drying.

Figure 4B:
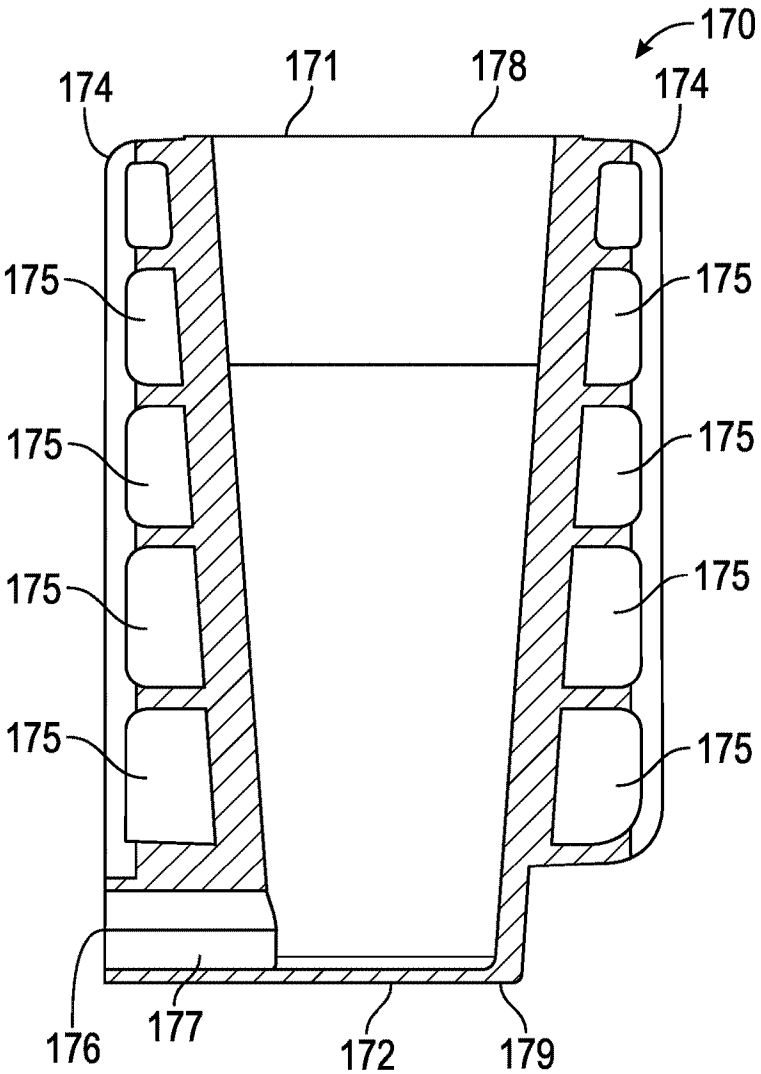
FIG. 4B shows a cross-section view of the injector nozzle according to the first illustrated embodiment.
Figure 4A:
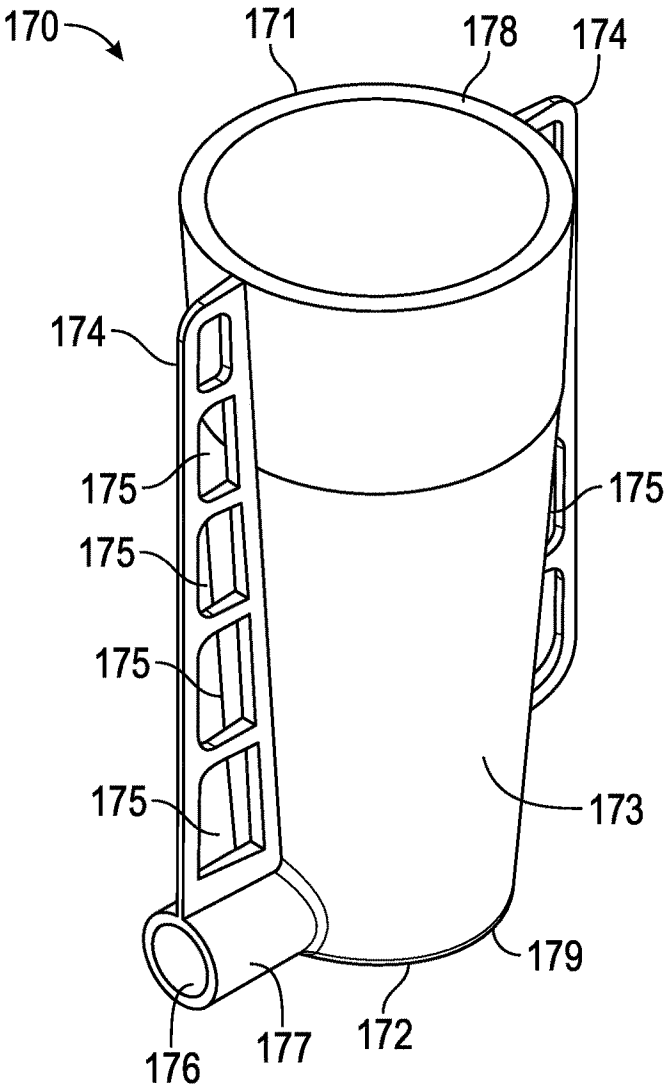
FIG. 4A shows a perspective view of an injector nozzle according to the first illustrated embodiment.

FIGS. 4A and 4B shows an injector nozzle (170) according to the first illustrated embodiment. The injector nozzle comprises a top side (171), a bottom side (172) opposite the top side, and an outer side surface (173) extending from the top side to the bottom side. As shown, the injector nozzle comprises a conical shape such that an upper diameter (178) is greater than a lower diameter (179). Other shapes can also be utilized. The injector nozzle further comprises two flanges (174) coupled to opposite ends of the outer side surface. Alternative number of flanges and disposition of flanges may also be used as can be appreciated by one having skill in the art. Each flange comprises flange apertures (175) extending through the flange. The flange apertures allow for a stronger attachment with a gasket seal. An injector opening (176) is disposed at or near the bottom side of the injector nozzle. The injector opening extends from the outer side surface by an opening channel (177). In some embodiments, one or more flanges is coupled to the outer side surface and further coupled to the opening channel.

As shown, the injector channel (177) comprises an angle with the injector nozzle (170) that can be characterized as being parallel with both the top side (171) and bottom side (172). The outer side surface (173) from which the opening channel extends outwardly from forms a channel angle with the opening channel. As shown, due to the injector nozzle comprising a conical shape, the channel angle is less than ninety degrees. Generally, the channel angle is less than ninety degrees to allow the injector opening (176) be properly positioned with a siphon waste. Preferably, the channel angle is greater than twenty degrees and less than ninety degrees. If the channel angle were greater than ninety or less than twenty degrees, the injector opening will likely not be aligned with the siphon waste.

Figure 5B:
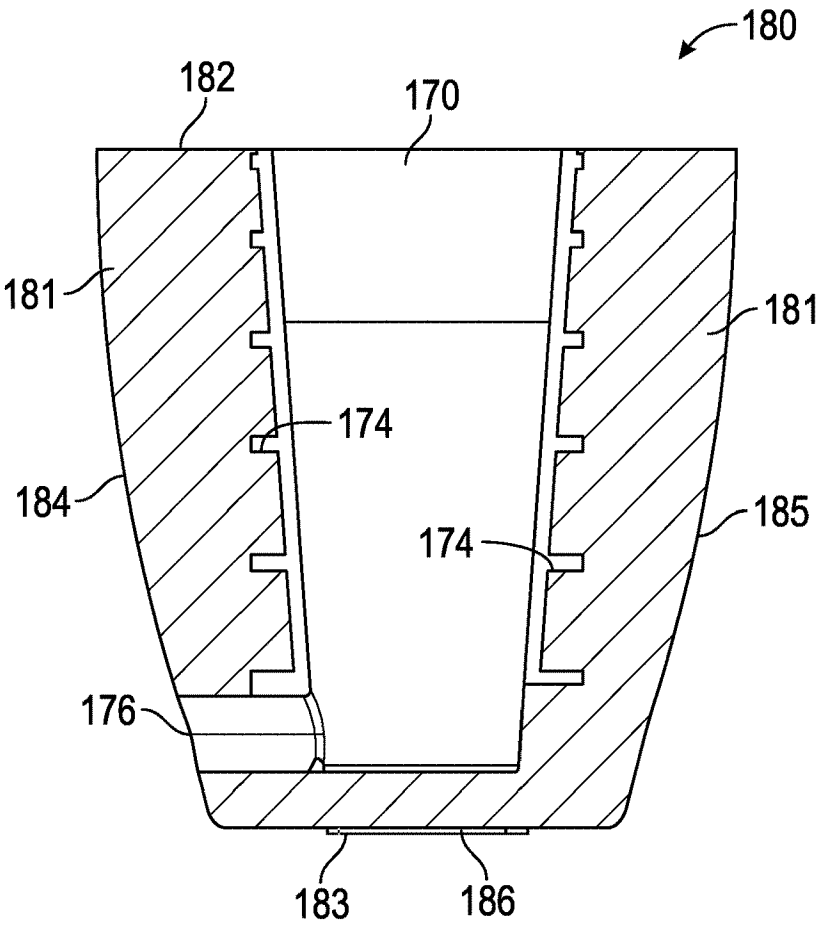
FIG. 5B shows a cross-section view of the gasket seal according to the first illustrated embodiment.
Figure 5A:
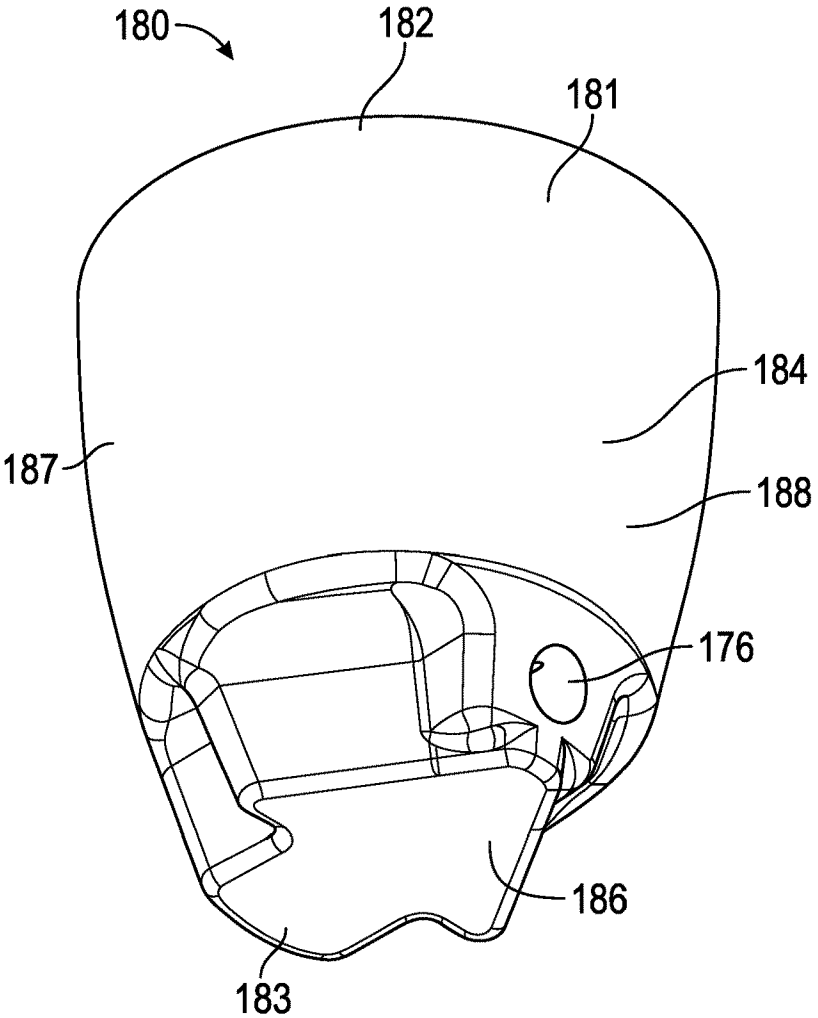
FIG. 5A shows a perspective view of a gasket seal according to the first illustrated embodiment.

FIGS. 5A and 5B shows a gasket seal (180) according to the first illustrated embodiment. The gasket seal comprises a top portion (182), a bottom portion (183) opposite the top portion, a front side (184), and a rear side (185) opposite the front side. The gasket seal surrounds an injector nozzle (170) such that the only portion of the injector nozzle accessible from an exterior of the gasket seal is an injector opening (176). The injector opening is positioned on the front side of the gasket seal. The gasket seal includes a gasket direction indicator (186) disposed on the bottom portion wherein the gasket direction indicator is aligned with the injector opening to indicate the front side of the gasket seal. In some embodiments, the gasket seal comprises a conical shape wherein the top portion is larger than the bottom portion. This allows for a uniform thickness with a conical shaped injector nozzle and further allows for easier placement of the gasket seal in a siphon junction while providing a sufficient seal. The gasket seal comprises a gasket depth (187) extending from the front side to the rear side, the gasket seal further comprises a gasket width (188) orthogonal to the gasket depth. In some embodiments, the gasket width is equal to the gasket depth. The gasket width and gasket depth each comprise a length such that the gasket seal can fit within a siphon junction while also sealing off a siphon waste from the toilet bowl as well as sealing off the siphon waste from the siphon jet. The bottom portion of the gasket seal is devoid of any holes, apertures or openings to the injector opening extends laterally through the front side of the gasket seal.

The gasket seal (180) comprises a resiliently deformable gasket material (181) sufficient for fitting within the siphon junction while sealing the siphon waste from the siphon jet and toilet bowl. The resiliently deformable gasket material should be resilient enough to resist back pressure coming from the injector nozzle (170) while be deformable enough to fit snugly at the siphon junction between the lower bowl aperture, the siphon jet, and the siphon waste. Various gasket material can be used as can be appreciated by one having skill in the art. In one embodiment, the resiliently deformable gasket material comprises a rubber having a hardness of 5 to 10 shore on the A scale. Other materials and levels of hardness may be utilized as can be appreciated by one having skill in the art.

Figure 6A:
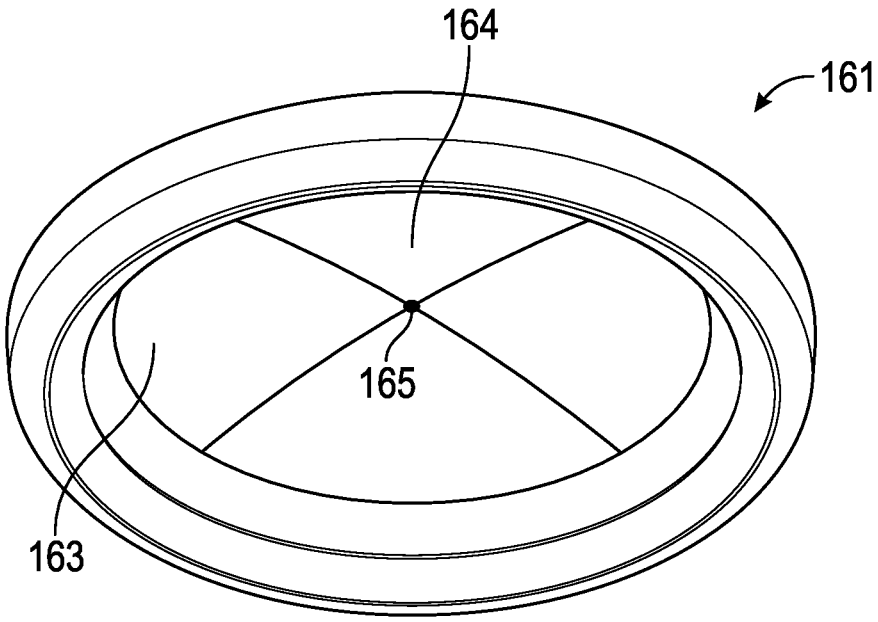
FIG. 6A shows a perspective view of an anti-drip seal according to the first illustrated embodiment.
Figure 6B:
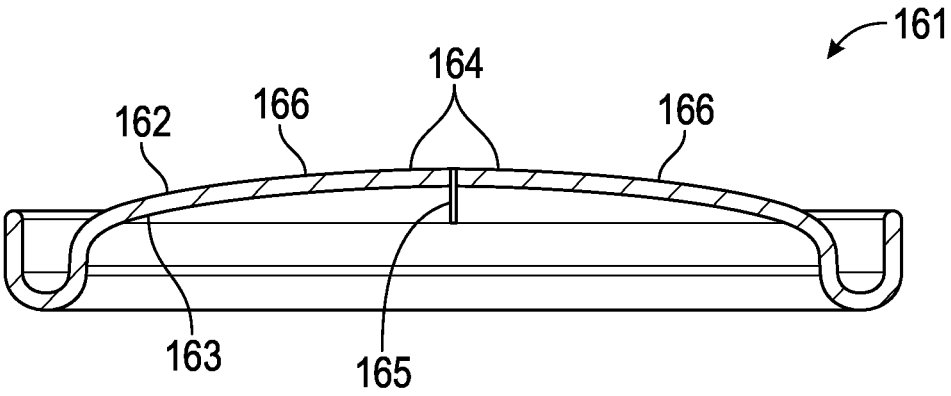
FIG. 6B show a cross-section view of the anti-drip seal according to the first illustrated embodiment.

FIGS. 6A and 6B shows an anti-drip seal (161) according to the first illustrated embodiment. The anti-drip seal comprises a seal upper surface (162) and a seal bottom surface (163). The anti-drip seal includes a plurality of flaps (164) that extends and meets at a center portion (165). The plurality of flaps comprises an upward arch (166) to allow fluid traveling upwards (from an injector nozzle to a reservoir tube when charging the reservoir tube) to require a lesser force than fluid traveling downwards (from the reservoir tube to the injector nozzle when discharging the reservoir tube). The anti-drip seal prevents dripping when the blockage clearing device is charged with fluid from a source away form the blockage.

Figure 7A:
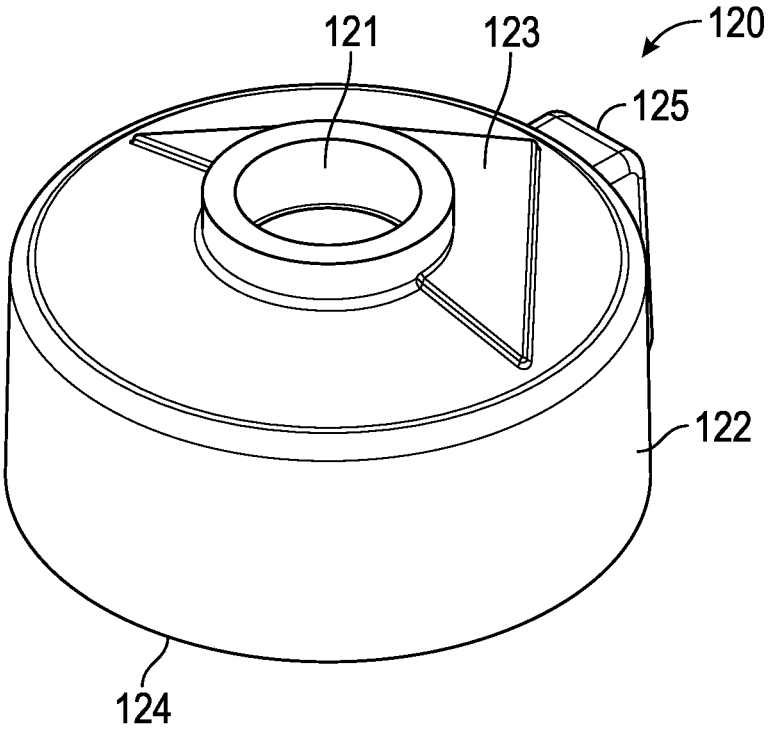
FIG. 7A shows a perspective view of a reservoir cap according to the first illustrated embodiment.
Figure 7B:
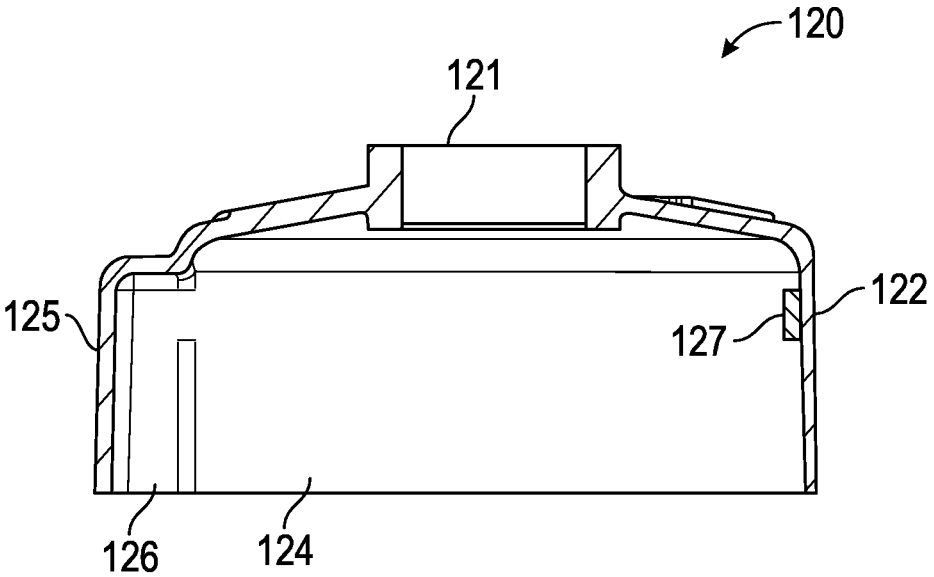
FIG. 7B shows a cross-section view of the reservoir cap according to the first illustrated embodiment.

FIGS. 7A and 7B shows a reservoir cap (120) according to the first illustrated embodiment. The reservoir cap comprises a plunger aperture (121) extending through the reservoir cap, the plunger aperture being configured to receive a plunger piston. The reservoir cap has a cap upper side and a cap bottom side (124) opposite the cap upper side. The cap bottom side is configured to couple with a reservoir tube. Disposed on the cap upper side is a cap direction indicator (123) wherein the cap direction indicator is aligned with an injector opening of an injector nozzle to indicate a front side of a gasket seal. A cap side surface (122) may comprise a reservoir vent (125) to allow air to travel in and out of the reservoir tube attached therewith. The reservoir vent may have a vent opening (126) positioned downwards relative to a user such that air traveling out of the vent opening is in a direction opposite the user. This allows foul odor that is present in the reservoir tube to be avoided by the user. In other embodiments, the vent opening is angled to emit air to a side of the reservoir cap. The reservoir cap may further comprise a reservoir tube stopper (127) disposed at an inner surface of the cap side surface. The reservoir tube stopper prevents the reservoir tube from extending further into the reservoir cap and possibly blocking the reservoir vent.

Figure 8:
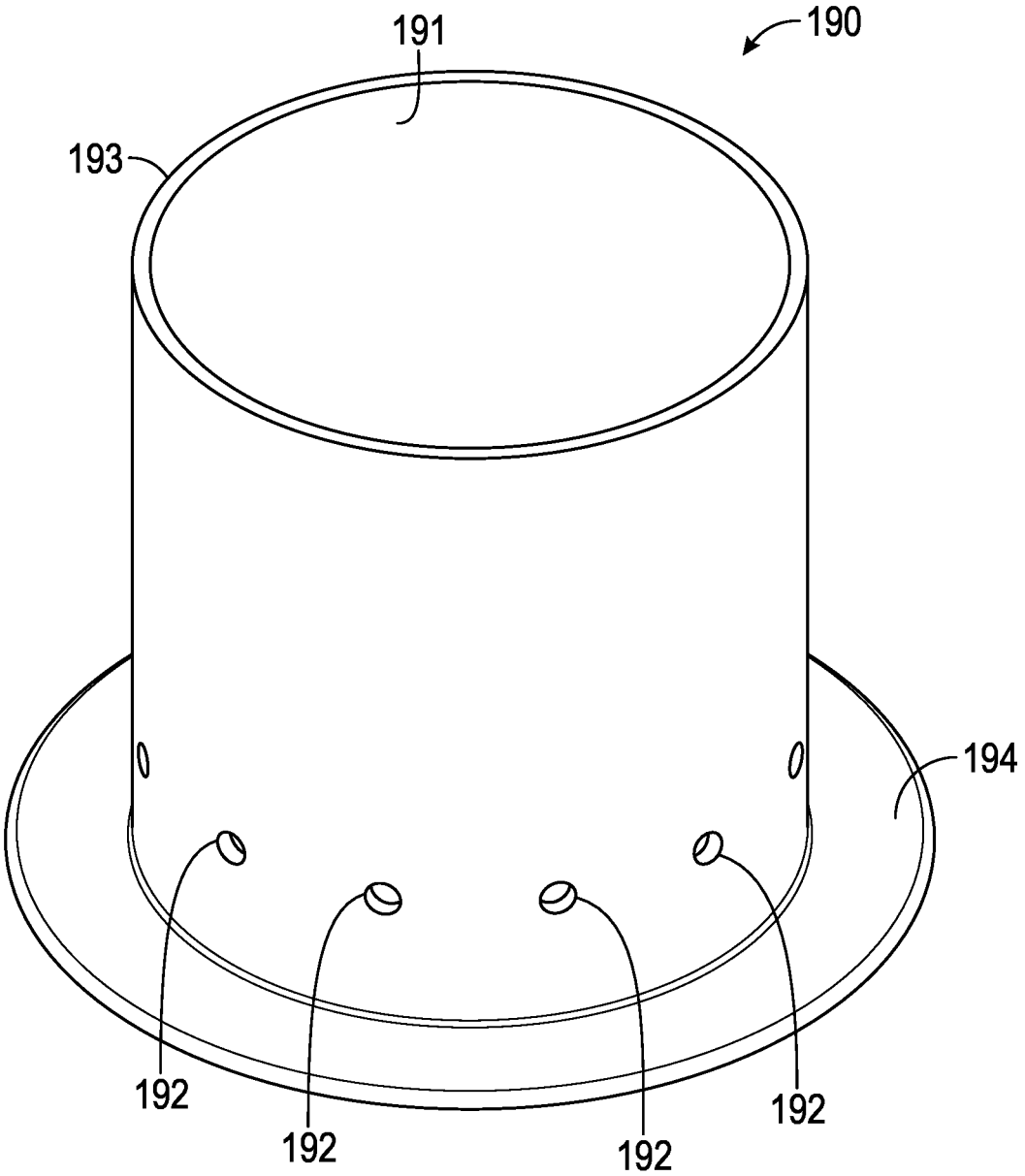
FIG. 8 shows a perspective view of a device stand according to the first illustrated embodiment.

FIG.8 shows a perspective view of a device stand (190) according to the first illustrated embodiment. The device stand comprises a stand top side (193) and a stand bottom side (194) opposite the stand top side. The device stand has a hollow cavity (191) configured to receive a gasket seal and injector nozzle of a blockage clearing device. A reservoir coupling of the blockage clearing device can be configured to contact the stand top side and thereby prevent the gasket seal from touching the stand bottom stand. A plurality of holes (192) is disposed near the stand bottom side to allow the gasket seal to dry and fluid residue to evaporate from the hollow cavity.

Figure 9:
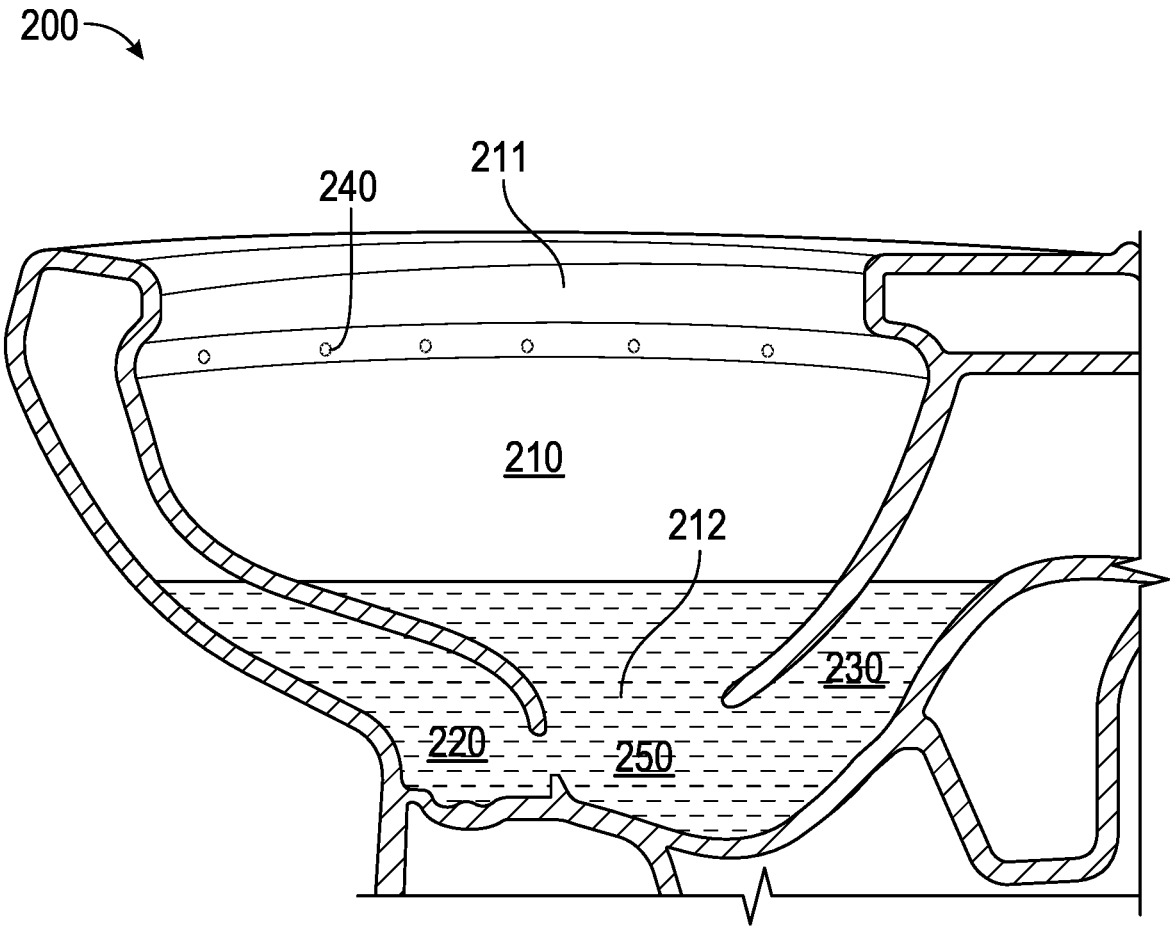
FIG. 9 shows a cross-section view of a conventional toilet with siphon jet.

FIG. 9 shows a cross-section view of a conventional toilet (200) with siphon jet (220). The toilet comprises a toilet bowl (210) having an upper bowl aperture (211) and a lower bowl aperture (212). The toilet includes the siphon jet and rim holes (240) configured to receive fluid during flushing. The siphon jet and rim holes are in fluid communication with one another. Fluid travels down the rim holes to clean the toilet bowl while also traveling through the siphon jet, past a siphon junction (250) and into a siphon waste (230) where waste is flushed away. The siphon junction is defined as the space below the lower bowl aperture and between the siphon jet and siphon waste. Conventional plungers cover just the lower bowl aperture without providing a seal between the siphon waste and siphon jet. Because the siphon jet is in fluid communication with the rim holes, a proper seal to the siphon waste is not possible. Additionally, waste blocking the siphon waste can be dislodged by the conventional plunger and travel back into the siphon jet and through the rim holes and into the toilet bowl.

Figure 10:
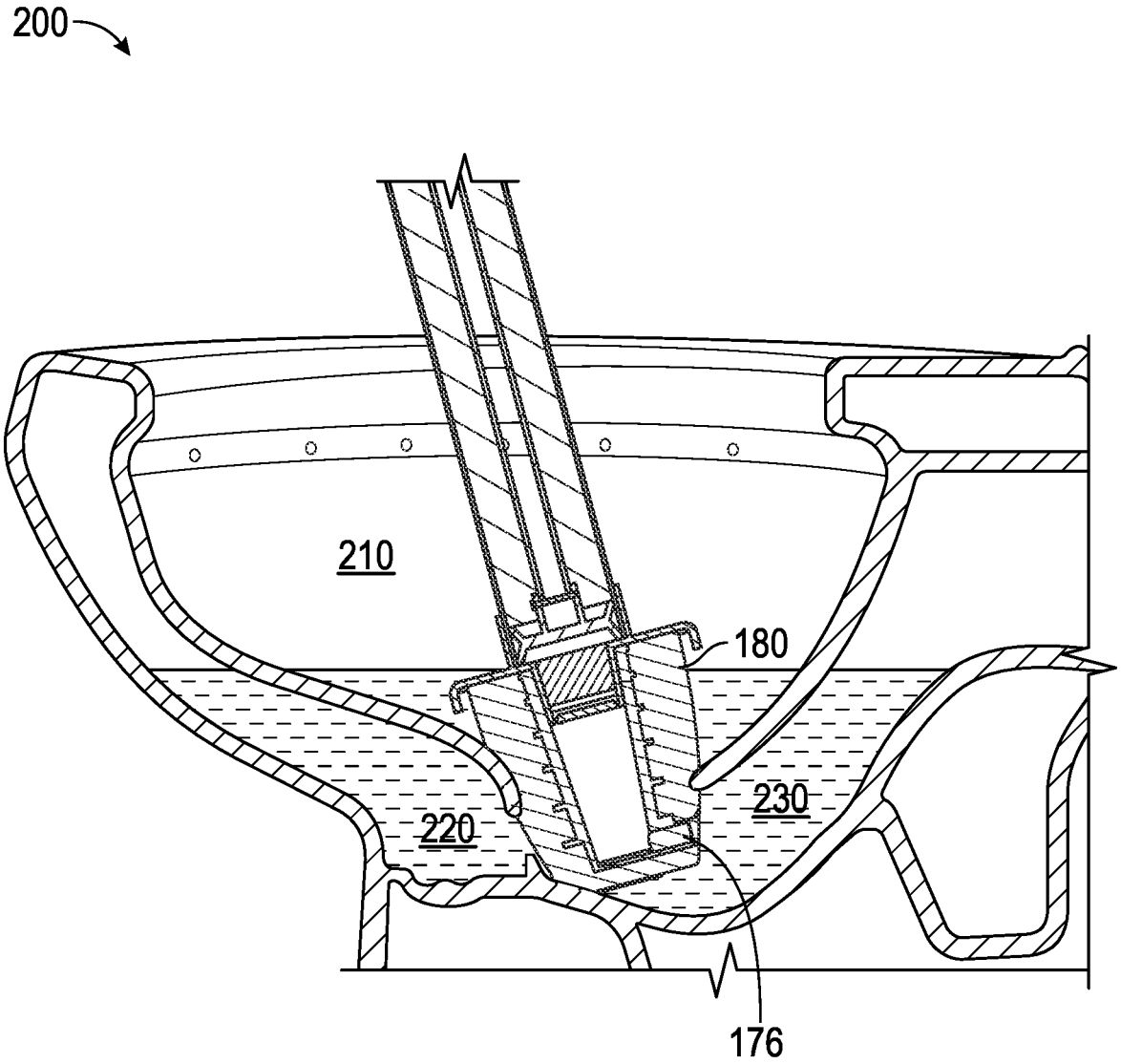
FIG. 10 shows a cross-section view of the blockage clearing device used with the conventional toilet.

FIG. 10 shows a cross-section view of the blockage clearing device (100) used with a conventional toilet (200). A gasket seal (180) of the blockage clearing device is disposed within a siphon junction (250). The gasket seal provides a seal between a siphon waste (230) and a toilet bowl (210). The gasket seal also provides a seal between the siphon waste and a siphon jet (220). A front side of the gasket seal is positioned into the siphon waste where a nozzle opening (176) is present. A back side of the gasket is positioned at the siphon jet. In such a configuration, the siphon waste is sealed off from the both the toilet bowl and siphon jet. Therefore, all pressure discharged by the blockage clearing device is directed to the siphon waste and is not diffused to the siphon jet. Additionally, any waste dislodged with the siphon waste does not travel back through the siphon jet and back into the toilet bowl. The gasket seal comprises a gasket width and a gasket depth sufficient to block the siphon jet from the siphon waste while also allowing a portion of the gasket seal to fit within the siphon junction to seal the toilet bowl from both the siphon waste and siphon jet.

Method of Use

Place the gasket seal into the toilet bowl's waste water or an independent water source (such as bowl or sink). Using the piston plunger handle, draw fluid into the device's reservoir tube. Gripping the reservoir tube, press the gasket seal firmly into the siphon junction, effectively sealing off the siphon waste from the toilet bowl and the siphon jet. With the gasket seal firmly in place, push down on the piston plunger handle. Fluid ejected through the injector nozzle and injector opening will cut through the organic blockage and allow the toilet to drain.

FEATURE LIST blockage clearing device (100)
piston plunger handle (110)
reservoir cap (120)
plunger aperture (121)
cap side surface (122)
cap direction indicator (123)

cap bottom side (124)
reservoir vent (125)
vent opening (126)
reservoir tube stopper (127)
piston plunger (130)
piston proximal end (131)
piston distal end (132)
reservoir tube (140)
tube proximal end (141)
tube distal end (142)
hollow interior (143)
inner wall (144)
piston plunger seal (150)
piston seal aperture (151)
piston seal periphery (152)
reservoir coupling (160)
anti-drip seal (161)
seal upper surface (162)
seal bottom surface (163)
plurality of flaps (164)
center portion (165)
upward arch (166)
seal retainer (167)
injector nozzle (170)
top side (171)
bottom side (172)
outer side surface (173)
flange (174)
flange apertures (175)
injector opening (176)
opening channel (177)
upper diameter (178)
lower diameter (179)
gasket seal (180)
resiliently deformable gasket material (181)
top portion (182)
bottom portion (183)
front side (184)
rear side (185)
gasket direction indicator (186)
gasket depth (187)
gasket width (188)
device stand (190)
hollow cavity (191)
plurality of holes (192)
stand top side (193)
stand bottom side (194)
toilet (200)
toilet bowl (210)
upper bowl aperture (211)
bottom bowl aperture (212)
siphon jet (220)
siphon waste (230)
rim holes (240)
siphon junction (250)

What is claimed is:

1. A blockage clearing device comprising:

a reservoir tube having a tube proximal end and a tube distal end opposite the tube proximal end, and a hollow interior extending from the tube proximal end to the tube distal end, the hollow interior configured to hold an amount of liquid;

a reservoir cap having a cap bottom side coupled to the tube proximal end, the reservoir cap further comprising a plunger aperture extending through the reservoir cap;

a piston plunger having a piston proximal end and a piston distal end opposite the piston proximal end, the piston proximal end extending through the reservoir cap, wherein the piston plunger further extends within the hollow interior of the reservoir tube;

a piston plunger seal coupled to the piston plunger at the piston distal end, the piston plunger seal comprising a piston seal periphery configured to abut an inner wall of the reservoir tube;

a reservoir coupling coupled to the reservoir tube at the tube distal end, the reservoir coupling comprising an anti-drip seal;

an injector nozzle extending away from the reservoir coupling from a top side to a bottom side of the injector nozzle, the injector nozzle having an outer side surface extending from the top side to the bottom side, the injector nozzle further comprising an injector opening configured to receive liquid external to the blockage clearing device for storage in the reservoir tube, wherein the injector nozzle is configured to release the liquid for clearing a blockage; and a gasket seal coupled to and surrounding the injector nozzle, wherein the injector opening is accessible from an exterior of the gasket seal;

wherein the anti-drip seal is configured to prevent liquid held in the reservoir tube from entering the injector nozzle.

2. The blockage clearing device of claim 1, the gasket seal further comprising a top portion and a bottom portion opposite the top portion, wherein the top portion is coupled to the reservoir coupling and the bottom portion comprises a gasket direction indicator aligned with the injector opening.

3. The blockage clearing device of claim 1, the injector nozzle further comprising one or more flanges disposed on the outer side surface of the injector nozzle.

4. The blockage clearing device of claim 3, wherein the one or more flanges comprise flange apertures extending through the one or more flanges.

5. The blockage clearing device of claim 3, wherein at least one of the one or more flanges is coupled to the outer side surface of the injector nozzle and further coupled to an opening channel.

6. The blockage clearing device of claim 1, wherein the injector opening extends outwardly from the outer side surface by an opening channel.

7. The blockage clearing device of claim 1, the reservoir cap further comprising a cap direction indicator.

8. A blockage clearing device comprising:

a reservoir tube having a tube proximal end and a tube distal end opposite the tube proximal end, and a hollow interior extending from the tube proximal end to the tube distal end, the hollow interior configured to hold an amount of liquid;

a piston plunger having a piston proximal end and a piston distal end opposite the piston proximal end, wherein the piston plunger extends within the hollow interior of the reservoir tube;

an injector nozzle coupled to the reservoir tube, the injector nozzle having a top side, a bottom side, and an outer side surface extending from the top side to the bottom side, the injector nozzle further comprising an injector opening configured to receive liquid external to the blockage clearing device for storage in the reservoir tube, wherein the injector nozzle is configured to release the liquid for clearing a blockage; and a gasket seal coupled to and surrounding the injector nozzle, wherein the injector opening is accessible from an exterior of the gasket seal.

9. The blockage clearing device of claim 8, further comprising a reservoir coupling coupled to the reservoir tube at the tube distal end, the reservoir coupling comprising an anti-drip seal, wherein the anti-drip seal is configured to prevent liquid held in the reservoir tube from entering the injector nozzle.

10. The blockage clearing device of claim 8, the gasket seal further comprising a top portion and a bottom portion opposite the top portion, wherein the top portion is coupled to the reservoir coupling and the bottom portion comprises a gasket direction indicator aligned with the injector opening.

11. The blockage clearing device of claim 8, the injector nozzle further comprising one or more flanges disposed on the outer side surface of the injector nozzle.

12. The blockage clearing device of claim 1, wherein the anti-drip seal is disposed within the injector nozzle.

13. The blockage clearing device of claim 1, the anti-drip seal further comprising a plurality of flaps wherein each of the plurality of flaps comprises an upward arch.

14. The blockage clearing device of claim 1, further comprising a device stand configured to surround the gasket seal, wherein the reservoir coupling is configured to contact a stand top side of the device stand.

15. The blockage clearing device of claim 9, wherein the anti-drip seal is disposed within the injector nozzle.

16. The blockage clearing device of claim 9, the anti-drip seal further comprising a plurality of flaps wherein each of the plurality of flaps comprises an upward arch.

17. The blockage clearing device of claim 9, further comprising a device stand configured to surround the gasket seal, wherein the reservoir coupling is configured to contact a stand top side of the device stand.

18. The blockage clearing device of claim 1, wherein the reservoir cap comprises a vent opening configured to dispel air in a direction towards the reservoir tube.

* * * * *